US010123678B1

(12) United States Patent
Boyer et al.

(10) Patent No.: US 10,123,678 B1
(45) Date of Patent: Nov. 13, 2018

(54) RACK ASSEMBLY FOR A DISHWASHER APPLIANCE

(71) Applicant: Haier US Appliance Solutions, Inc., Wilmington, DE (US)

(72) Inventors: Joel Charles Boyer, Louisville, KY (US); Matthew David Mersch, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/627,499

(22) Filed: Jun. 20, 2017

(51) Int. Cl.

| | |
|---|---|
| ***A47L 15/16*** | (2006.01) |
| ***A47L 15/22*** | (2006.01) |
| ***A47L 15/42*** | (2006.01) |
| ***A47L 15/50*** | (2006.01) |

(52) U.S. Cl.
CPC ..... *A47L 15/508* (2013.01); *A47L 15/16* (2013.01); *A47L 15/22* (2013.01); *A47L 15/4221* (2013.01); *A47L 15/502* (2013.01); *A47L 15/507* (2013.01)

(58) Field of Classification Search
CPC ..... A47L 15/16; A47L 15/22; A47L 15/4221; A47L 15/502; A47L 15/507; A47L 15/508
USPC ..... 134/56 D, 57 D, 58 D, 199
See application file for complete search history.

(56) References Cited

U.S. PATENT DOCUMENTS

| | | | | |
|---|---|---|---|---|
| 5,357,993 | A | 10/1994 | St. Martin | |
| 6,582,654 | B1 | 6/2003 | Kral et al. | |
| 2005/0039777 | A1 | 2/2005 | Jerg et al. | |
| 2012/0291827 | A1* | 11/2012 | Buddharaju | A47L 15/4278 134/198 |
| 2014/0190525 | A1 | 7/2014 | Porcaro, II et al. | |
| 2015/0245762 | A1 | 9/2015 | Tuller | |

FOREIGN PATENT DOCUMENTS

| | | | |
|---|---|---|---|
| DE | 10322423 | A1 | 12/2004 |
| WO | WO2016155797 | A1 | 10/2016 |

* cited by examiner

*Primary Examiner* — Levon J Shahinian
(74) *Attorney, Agent, or Firm* — Dority & Manning, P.A.

(57) ABSTRACT

A dishwasher appliance is provided having an upper rack assembly that includes a rack that defines a vertical support structure and a manifold base. A manifold cap is attached to the rack over the manifold base such that the manifold cap and the manifold base define a spray manifold. A docking port is defined in a rear wall of the rack for providing fluid communication between the spray manifold and a fluid circulation assembly when the rack is positioned within the wash chamber.

20 Claims, 9 Drawing Sheets

RACK ASSEMBLY FOR A DISHWASHER APPLIANCE

FIELD OF THE INVENTION

The present disclosure relates generally to dishwasher appliances, and more particularly to improved rack assemblies for dishwasher appliances.

BACKGROUND OF THE INVENTION

Dishwasher appliances generally include a tub that defines a wash chamber. Certain dishwasher appliances also include one or more rack assemblies mounted within the wash chamber for receipt of articles for washing. For example, a user can slide the rack assemblies out of the wash chamber and load suitable articles into the rack assembly. After loading is complete, the user may slide the rack assemblies back into the wash chamber to perform one or more operating cycles of the dishwasher appliance, e.g., to clean, rinse, or dry the articles.

During certain operating cycles, wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

In addition to conventional lower and middle rack assemblies, certain dishwasher appliances include a "third rack" or "upper rack" positioned above the lower and middle rack assemblies, e.g., for receiving flatware, cutlery, or other cooking utensils. A spray assembly may be positioned at a top of the wash chamber for cascading water down onto the upper rack, but such a spray assembly may not be effective for cleaning certain articles such as flatware or cooking utensils placed within the upper rack facing downward. Thus, the addition of an upper rack may necessitate additional spray assemblies to ensure adequate effectiveness of the wash and/or rinse cycles. However, space restrictions within the wash chamber often limit the number, size, and/or position of spray assemblies.

Accordingly, a dishwasher appliance that utilizes an improved rack assembly and spray assembly would be useful. More specifically, an upper rack assembly incorporating a dedicated, low profile spray assembly would be particularly beneficial.

BRIEF DESCRIPTION OF THE INVENTION

The present subject matter provides a dishwasher appliance having an upper rack assembly that includes a rack that defines a vertical support structure and a manifold base. A manifold cap is attached to the rack over the manifold base such that the manifold cap and the manifold base define a spray manifold. A docking port is defined in a rear wall of the rack for providing fluid communication between the spray manifold and a fluid circulation assembly when the rack is positioned within the wash chamber. Additional aspects and advantages of the invention will be set forth in part in the following description, may be apparent from the description, or may be learned through practice of the invention.

In accordance with one exemplary embodiment of the present disclosure, a dishwasher appliance defining a vertical, a lateral, and a transverse direction is provided. The dishwasher appliance includes a wash tub that defines a wash chamber for receipt of articles for washing and a fluid circulation assembly for providing a flow of wash fluid for cleaning articles placed within the wash chamber. An upper rack assembly includes a rack slidably positioned within the wash chamber and configured for movement along the transverse direction between a first position where the rack is positioned within the wash chamber and a second position where the rack is positioned outside the wash chamber, the rack defining a vertical support structure and a manifold base. A manifold cap is attached to the rack, the manifold cap and the manifold base defining a spray manifold. A docking port provides fluid communication between the spray manifold and the fluid circulation assembly when the rack is in the first position.

In accordance with another exemplary embodiment of the present disclosure, an upper rack assembly for a dishwasher appliance is provided. The dishwasher appliance defines a vertical, a lateral, and a transverse direction and includes a wash tub defining a wash chamber and a fluid circulation assembly for providing a flow of wash fluid to the wash chamber. The upper rack assembly includes a rack slidably positioned within the wash chamber and configured for movement along the transverse direction between a first position where the rack is positioned within the wash chamber and a second position where the rack is positioned outside the wash chamber, the rack defining a vertical support structure and a manifold base. A manifold cap is attached to the rack, the manifold cap and the manifold base defining a spray manifold. A docking port provides fluid communication between the spray manifold and the fluid circulation assembly when the rack is in the first position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
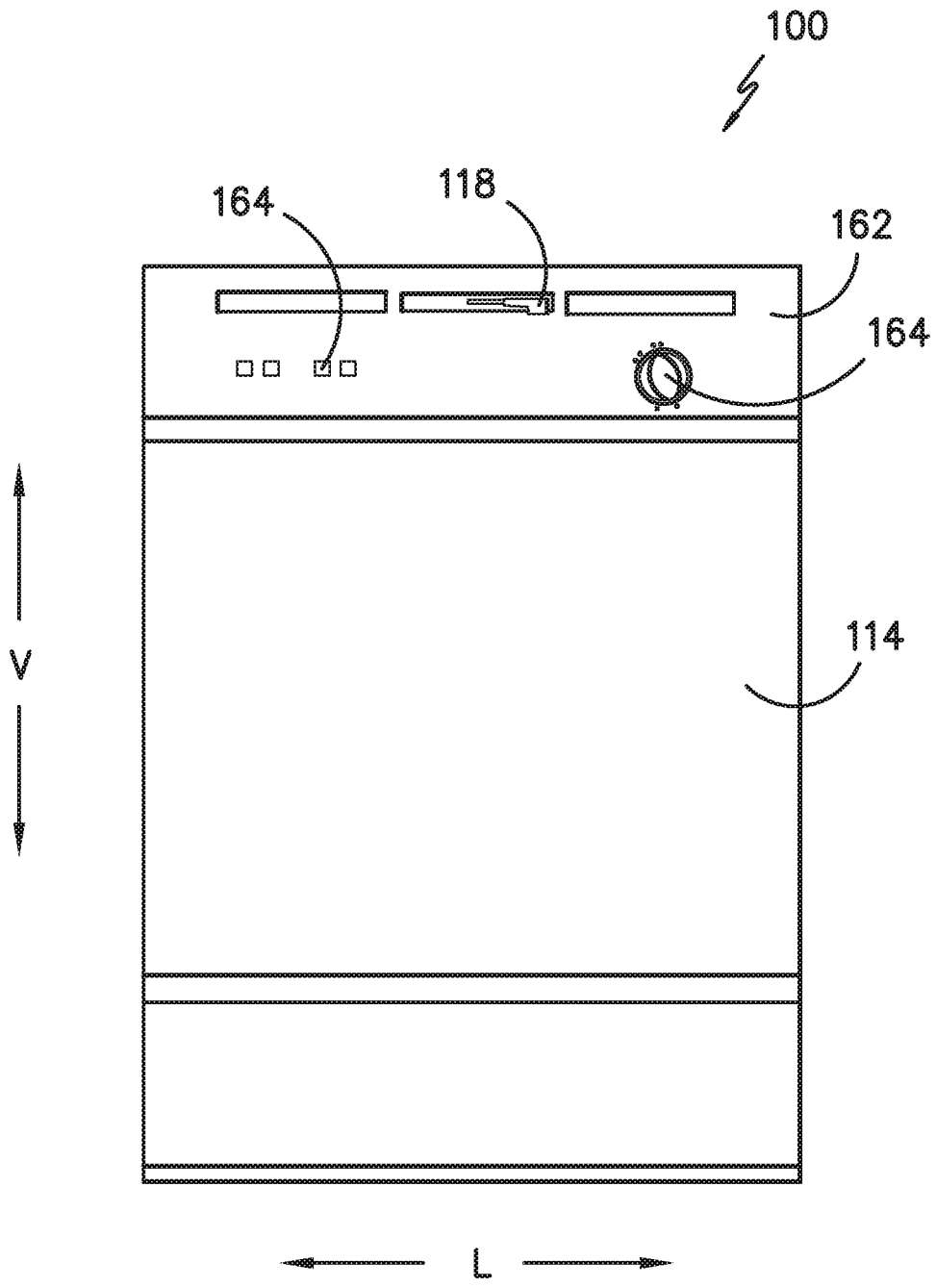
FIG. 1 provides a front view of an exemplary embodiment of a dishwashing appliance of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
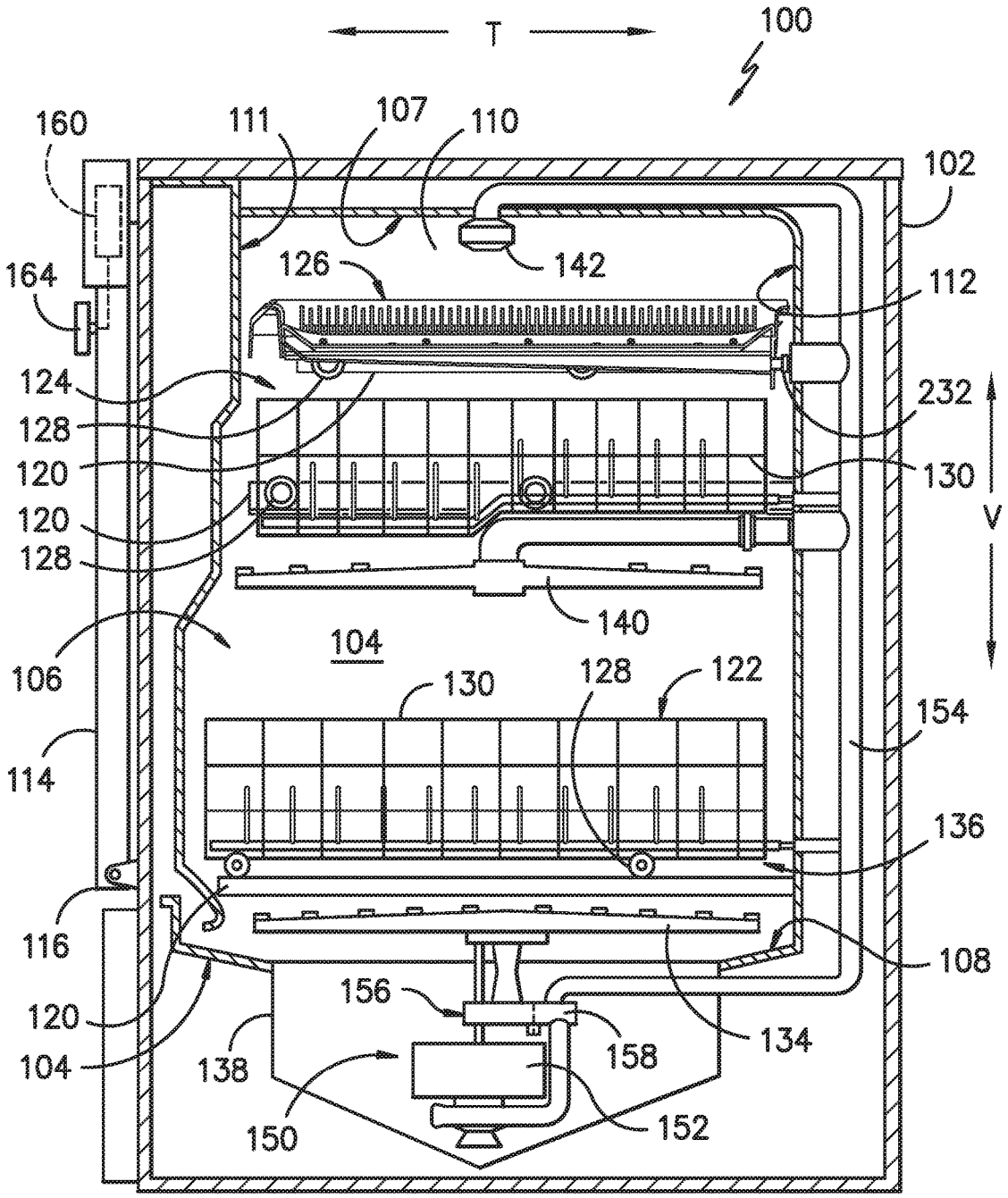
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another. The tub 104 includes a front opening (not shown) and a door 114 hinged at its bottom 116 for movement between a normally closed vertical position (shown in FIGS. 1 and 2), wherein the wash chamber 106 is sealed shut for washing operation, and a horizontal open position for loading and unloading of articles from the dishwasher 100. Latch 118 is used to lock and unlock door 114 for access to wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold, as will be described in more detail below with respect to FIGS. 3 through 9.

The various spray assemblies and manifolds described herein may be part of a fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

In operation, pump 152 draws wash fluid in from sump 138 and pumps it to a diverter assembly 156. Diverter assembly 156 may include a diverter disc (not shown) disposed within a diverter chamber 158 for selectively distributing the wash fluid to the spray arm assemblies 134, 140, 142 and/or other spray manifolds or devices. For example, the diverter disc may have a plurality of apertures that are configured to align with one or more outlet ports at the top of diverter chamber 158. In this manner, the diverter disc may be selectively rotated to provide wash fluid to the desired spray device, e.g., through primary supply conduit 154.

In addition, each spray arm assembly 134, 140, 142, manifold, or device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 114 as shown in FIGS. 1 and 2. In such an embodiment, input/output ("I/O") signals may be routed between the control system and various operational components of dishwasher 100 along wiring harnesses that may be routed through the bottom 116 of door 114. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Referring now generally to FIGS. 3 through 9, upper rack assembly 126 will be described according to an exemplary embodiment of the present subject matter. As illustrated in FIG. 2, upper rack assembly 126 is positioned at a top of wash chamber 106. However, it should be appreciated that upper rack assembly 126 could be positioned at any suitable location within any other suitable dishwasher appliance. Moreover, aspects of the present subject matter may be applied to improve the position, configuration, and effectiveness of any suitable rack and/or spray assembly.

Figure 3:
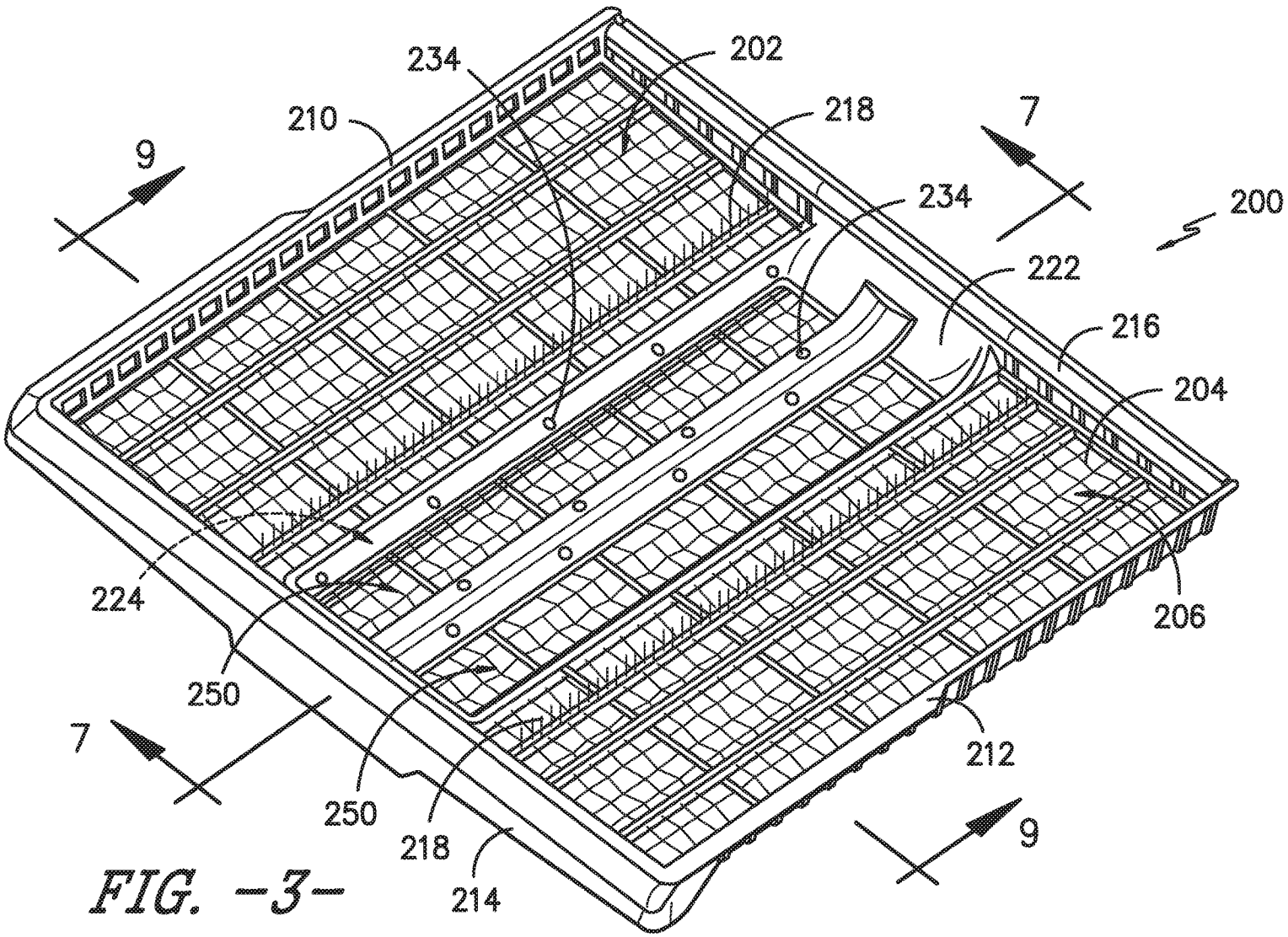
FIG. 3 provides a perspective view of an upper rack assembly that may be used with the exemplary dishwashing appliance of FIG. 1 according to an example embodiment of the present subject matter.

As best illustrated in FIG. 3, upper rack assembly 126 generally includes a rack 200 including a vertical support structure 202 that extends substantially along a horizontal plane defined by the lateral direction L and the transverse direction T. Vertical support structure 202 generally includes a plurality of elongated members or wires 204 interwoven to form a lattice structure or other suitable support for articles positioned within rack 200 while not providing excessive obstruction to the flow of wash fluid. According to the illustrated embodiment, wires 204 are injection molded using a suitable plastic material. However, according to alternative embodiments, wires 204 may be metal wire interwoven to define vertical support structure 202. Rack 200 may include apertures 206 defined by the mesh or lattice structure of wires 204. Apertures 206 may be any suitable size for preventing articles from falling through while facilitating the wash and rinse cycles of dishwasher 100.

Rack 200 also includes a first side wall 210 and a second side wall 212 separated along the lateral direction L and a front wall 214 and a rear wall 216 separated along the transverse direction T. Similar to vertical support structure 202, walls 210-216 may generally define apertures 206 through which wash fluid may flow Apertures 206 may be sized to reduce overall weight without sacrificing the rigidity of rack 200. In addition, similar to lower rack assembly 122 and middle rack assembly 124, upper rack assembly 126 may include any suitable sliding mechanism to facilitate movement of rack 200 along the transverse direction T. More specifically, referring again to FIG. 2 for example, rollers 128 may be mounted onto first side wall 210 and second side wall 212 of rack 200, which may thereby roll along guide rails 120 mounted onto side walls 110 of tub 104. In this manner, rack 200 is slidably positioned within wash chamber 106 and configured for movement along the transverse direction T between a first position where rack 200 is positioned within wash chamber 106 (as shown in FIG. 2) and a second position where rack 200 is positioned outside wash chamber 106 (not shown).

Rack 200 may generally be any suitable size and may include any suitable features as needed for supporting a particular type or quantity of articles depending on the application. For example, according to the illustrated embodiment, rack 200 extends along substantially an entire width of wash chamber 106 (i.e., along the lateral direction L) and substantially an entire depth of wash chamber 106 (i.e., along the transverse direction T). In this manner, vertical support structure 202 can generally be configured for holding a large number of cooking utensils, measuring cups, cutlery, and other articles in a single horizontal layer within wash chamber 106 for improved cleaning and rinsing. In addition, rack 200, or more specifically vertical support structure 202, may further include a plurality of tines 218 extending substantially along the vertical direction V for holding articles for washing.

Figure 4:
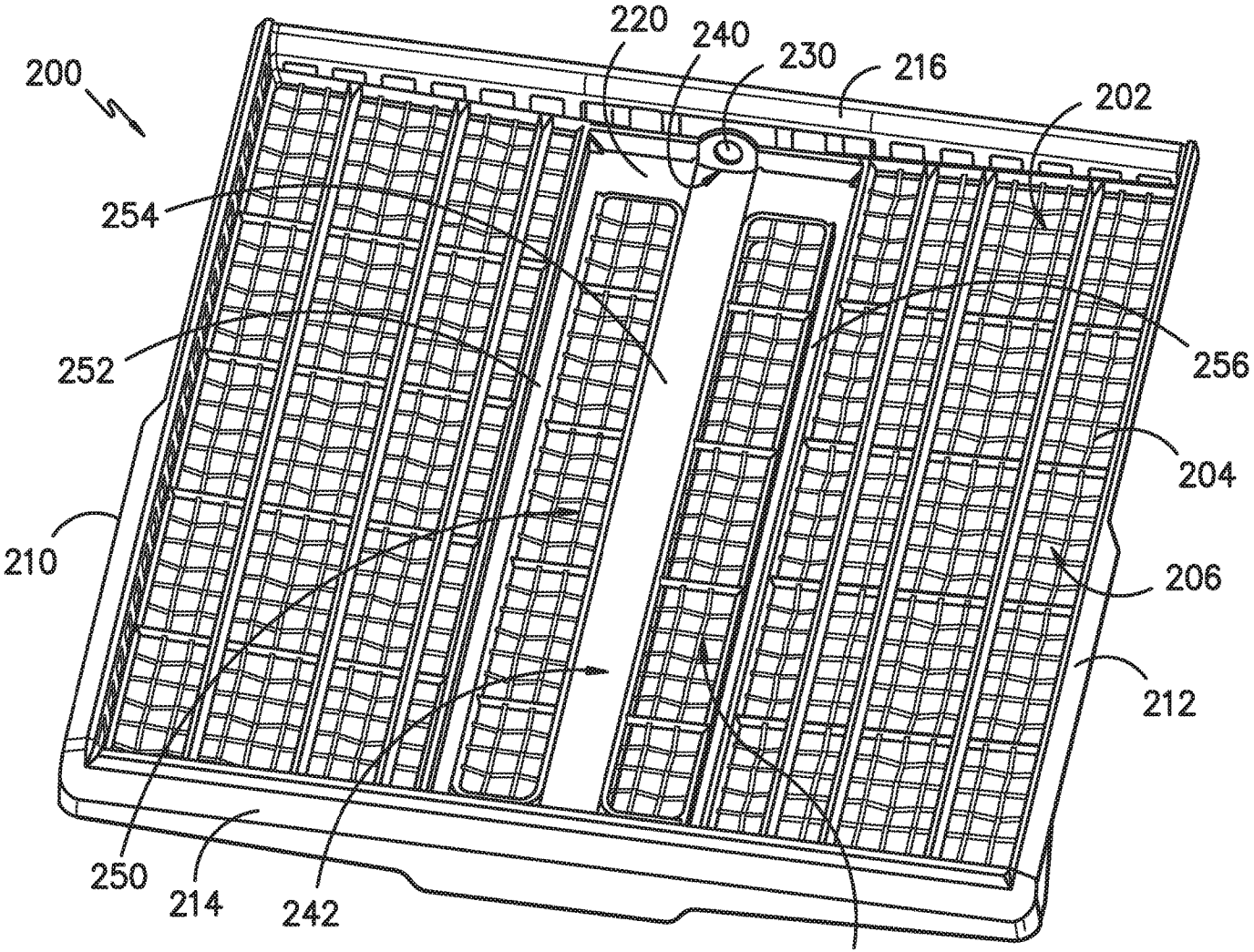
FIG. 4 provides a perspective view of the exemplary upper rack assembly of FIG. 3 with a manifold cap removed to reveal a manifold base according to an example embodiment of the present subject matter.
Figure 5:
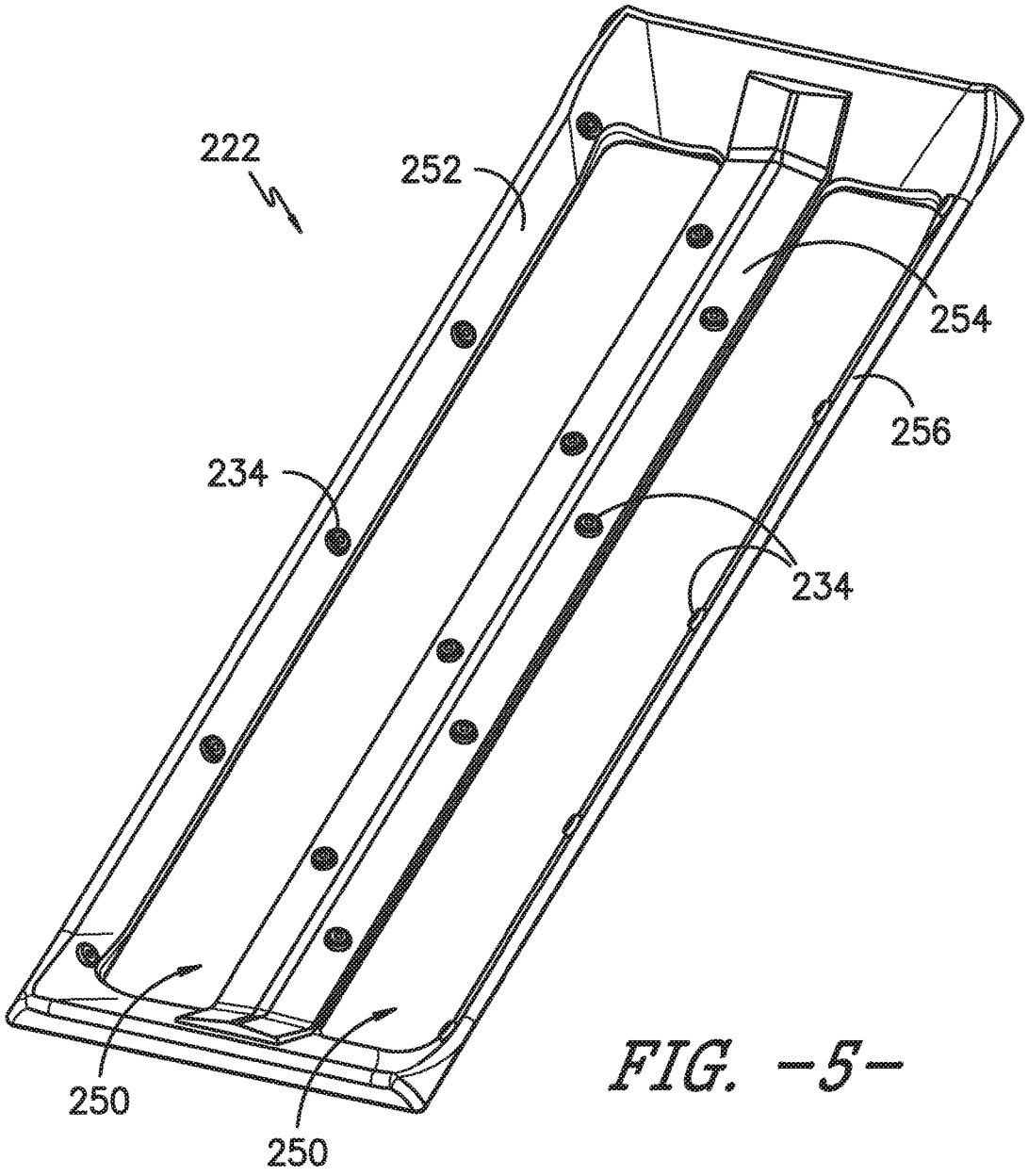
FIG. 5 provides a perspective view of a manifold cap of the exemplary upper rack assembly of FIG. 3 according to an example embodiment of the present subject matter.

Referring now also to FIG. 4, rack 200 defines a manifold base 220. According to the illustrated embodiment, manifold base 220 is integrally formed with rack 200, e.g., in a single molding process. In addition, as illustrated, manifold base 220 may be defined, at least in part, by front wall 214 and rear wall 216 of rack 200. In addition, as shown in FIG. 5, upper rack assembly 126 includes a manifold cap 222 that is attached to rack 200 over manifold base 220 to define a spray manifold 224. For example, according to one exemplary embodiment, manifold cap 222 is injection molded using a suitable plastic material and then welded or otherwise joined with manifold base 220 to form a substantially water tight spray manifold 224.

Figure 6:
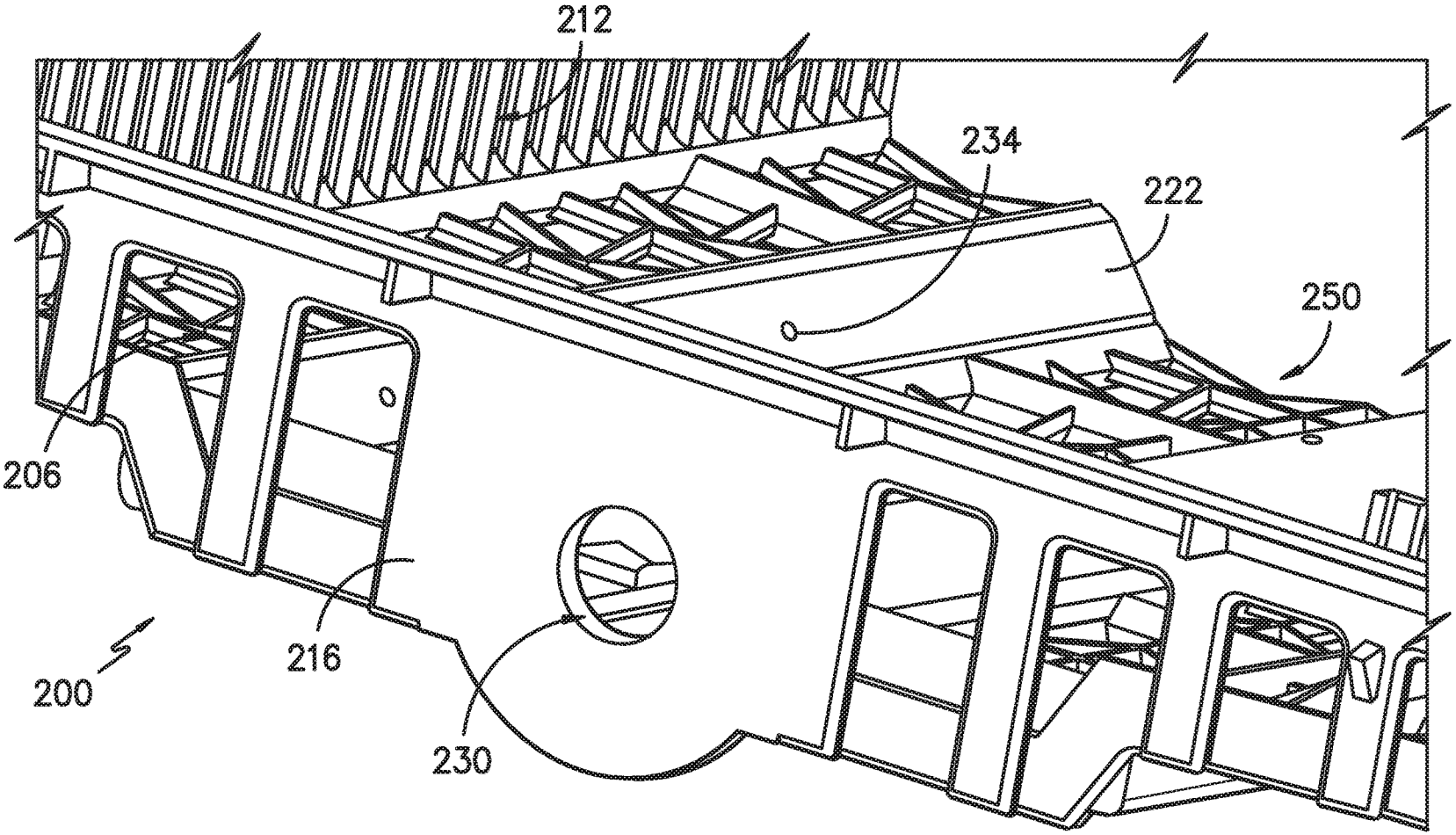
FIG. 6 provides a rear perspective view of a rear wall of the exemplary upper rack assembly of FIG. 3 according to an example embodiment of the present subject matter.

Referring now also to FIG. 6, rear wall 216 of rack 200 may define a docking port 230 configured for providing fluid communication between spray manifold 224 and fluid circulation assembly 150, e.g., via primary supply conduit 154. More specifically, referring again briefly to FIG. 2, fluid circulation assembly 150 may include a fluid supply nozzle 232 that is in configured for engaging docking port 230 in a substantially fluid tight manner when rack 200 is in the first position. In this manner, when rack 200 is positioned within wash chamber 106, e.g., during a wash cycle, fluid supply nozzle 232 provides fluid communication between primary supply conduit 154 and spray manifold 224 such that pump 152 may urge a flow of wash fluid into spray manifold 224. Although docking port 230 is illustrated as being defined in rear wall 216, it should be appreciated that spray manifold 224 may be placed in fluid communication with fluid circulation assembly 150 in any other suitable manner according to alternative embodiments.

In addition, referring generally to FIGS. 3 and 5, manifold cap 222 defines a plurality of discharge ports 234 for directing the flow of wash fluid from spray manifold 224 onto articles positioned within rack 200. Any suitable number, size, configuration, and angle of discharge ports 234 may be selected for facilitating improved distribution of wash fluid. For example, according to the illustrated embodiment, discharge ports 234 are oriented at an angle relative to the vertical direction V in order to ensure the flow of wash fluid is directed to the desired region. According to one exemplary embodiment, the angle of discharge ports 234 is between about 0 and 45 degrees relative to the vertical direction V. In addition, according to alternative embodiments, each discharge port 234 may have a different angle than adjacent discharge ports 234 or discharge ports 234 may oscillate back and forth within a particular range of motion. Other spray configurations are possible and within the scope of the present subject matter.

Figure 7:
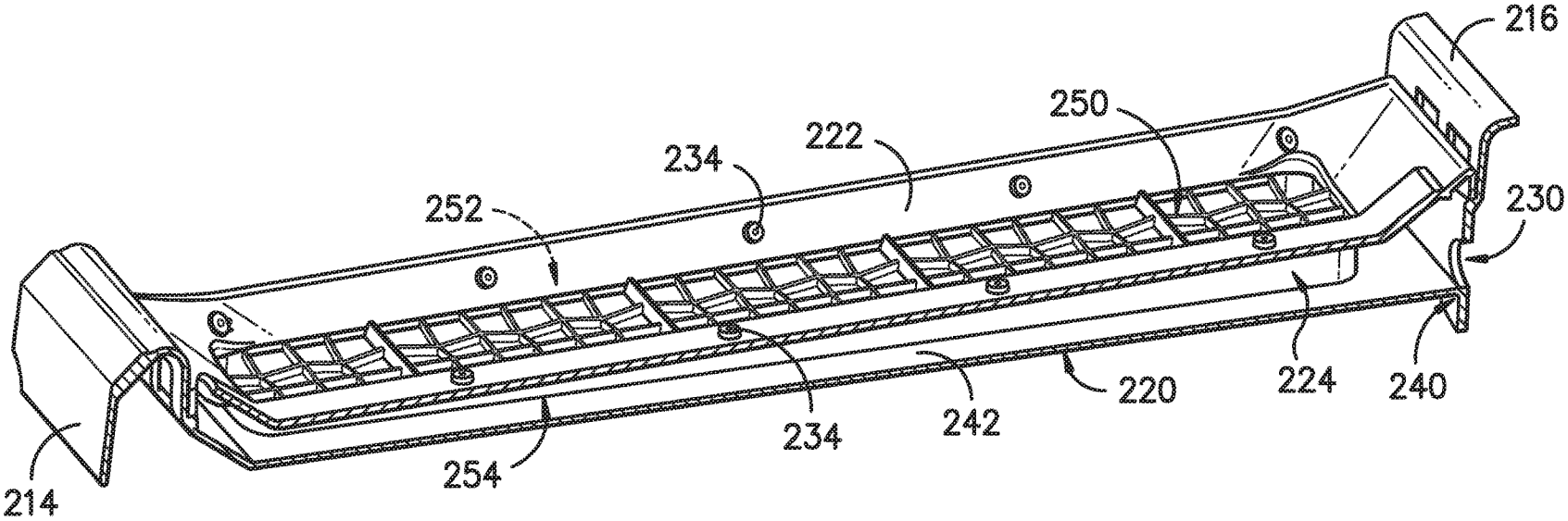
FIG. 7 provides a perspective, cross-sectional view of the exemplary upper rack assembly of FIG. 3 taken along Line 7-7 of FIG. 3.
Figure 8:
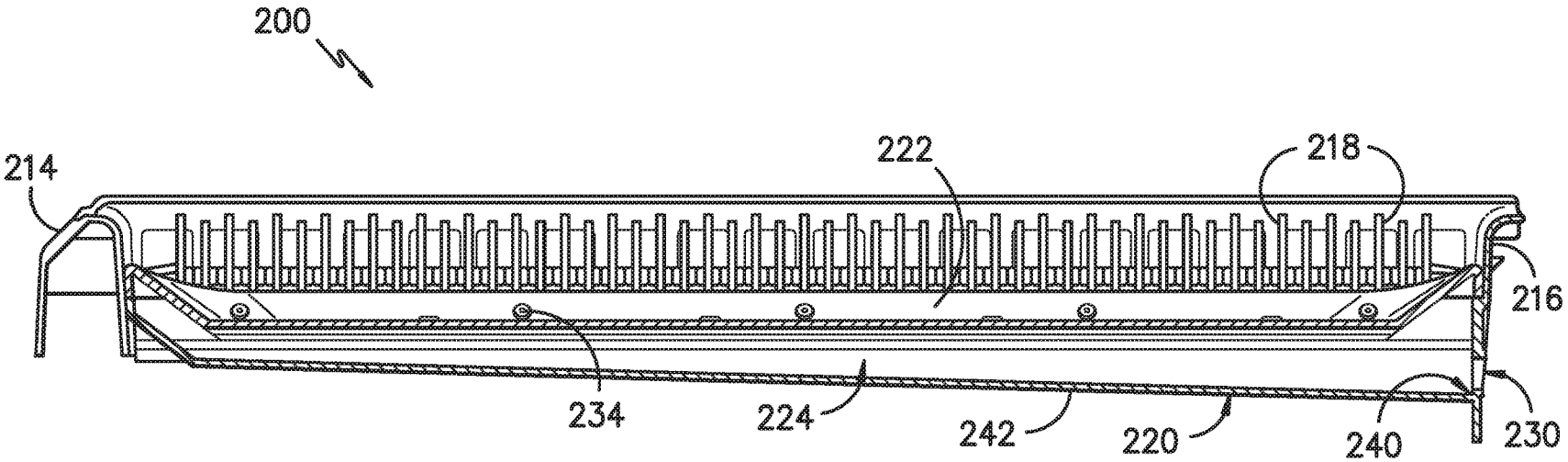
FIG. 8 provides a side, cross-sectional view of the exemplary upper rack assembly of FIG. 3 taken along Line 7-7 of FIG. 3.
Figure 9:
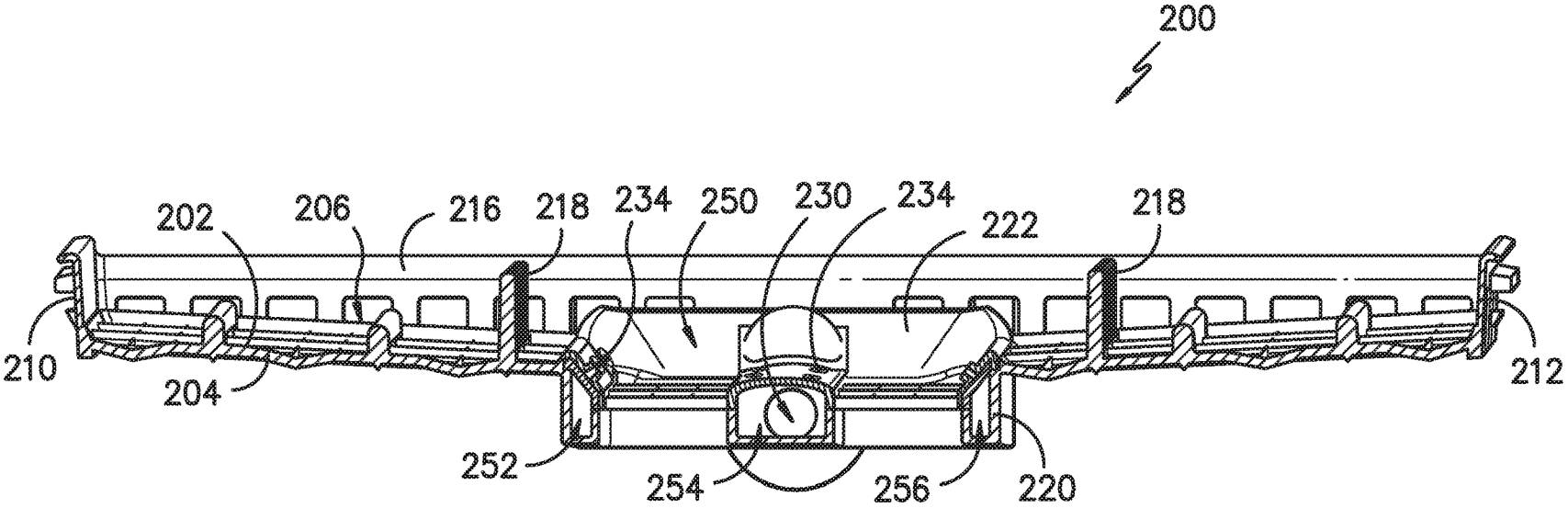
FIG. 9 provides a front, cross-sectional view of the exemplary upper rack assembly of FIG. 3 taken along Line 9-9 of FIG. 3.

According to exemplary embodiments, manifold base 220 and/or manifold cap 222 may have suitable size, shape, and orientation for facilitating improved wash fluid management. For example, as best shown in FIGS. 7 and 8, docking port 230 is positioned at a bottom or lowest point 240 of spray manifold 224 along the vertical direction V. Such a construction ensures proper drainage of spray manifold 224, e.g., to prevent dripping when rack 200 is moved to the second position. In addition, such a construction decreases the prime value or the head necessary to pressurize spray manifold 224. In addition, a bottom wall 242 of manifold base 220 generally slopes toward the lowest point 240. More specifically, for example, bottom wall 242 slopes downward along the vertical direction V toward rear wall 216 and downward toward docking port 230 along the lateral direction L of rack 200 such that the lowest point 240 of spray manifold 224 is positioned at rear wall 216 of rack 200. According to one exemplary embodiment, the slope of bottom wall may be between about 0 and 10 degrees relative to the lateral direction L and between about 0 and 10 degrees relative to the transverse direction T.

According to the illustrated embodiment, rack 200 is configured as a cutlery tray for washing cutlery and cooking utensils having a handle at one end and another end which is generally soiled or is in primary food contact such that it needs focused cleaning. As such, spray manifold 224 defines one or more primary spray regions 250 at a center of 220 rack 200 along the lateral direction L. In this regard, for example, spray manifold 224 includes a left channel 252, a middle channel 254, and a right channel 256 which define two primary spray regions 250 therebetween. Each of the left channel 252, the middle channel 254, and the right channel 256 (and thus the primary spray regions 250) extend along the transverse direction T from front wall 214 to rear wall 216 of rack 200. In addition, each channel 252-256 may be in fluid communication with one or more of the plurality of discharge ports 234, which are angled in any suitable manner to facilitate improved cleaning. For example, as illustrated, discharge ports 234 are angled toward the primary spray regions 250. In this regard, two rows of utensils may be positioned in rack 200 with the handle ends positioned outward along the lateral direction L and the soiled ends positioned within the primary spray regions 250.

It should be appreciated that upper rack assembly 126 is used only for the purpose of explaining aspects of the present subject matter. Modifications and variations may be made to upper rack assembly 126 while remaining within the scope of the present subject matter. For example, the size, configuration, and position of spray manifold 224 may vary, the number, position, and orientation of discharge ports 234 may be changed, and other features may be adjusted while remaining within the scope of the present subject matter.

Upper rack assembly 126 as described above provides a low profile means for supplying a flow of wash fluid directly onto articles positioned within rack 200. The flow of wash fluid is directed upward onto the articles and may provide a more effective cleaning than can be achieved using upper spray assembly 142 alone, particularly when cleaning flatware and cooking utensils. The upper rack assembly 126 quickly and easily docks with fluid circulation assembly 150 when rack 200 is moved to the first position and minimizes additional plumbing necessary for providing wash fluid to spray manifold 224. In addition, by manufacturing manifold cap 222 separately from manifold base 220, the molding process may be simplified and a secondary color may be used to emphasize the unique dishwasher feature, thereby enhancing the marketability and/or consumer satisfaction with dishwasher 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a wash tub that defines a wash chamber for receipt of articles for washing;

a fluid circulation assembly for providing a flow of wash fluid for cleaning articles placed within the wash chamber;

an upper rack assembly comprising:

a rack slidably positioned within the wash chamber and configured for movement along the transverse direction between a first position where the rack is positioned within the wash chamber and a second position where the rack is positioned outside the wash chamber, the rack defining a vertical support structure;

a manifold base integrally formed with the rack and forming a bottom wall of a spray manifold, the bottom wall comprising a plurality of distinct channels;

a manifold cap attached to the rack over the manifold base to form an upper wall of the spray manifold, the manifold cap defining a plurality of discharge ports positioned below a top of the manifold cap along the vertical direction; and a docking port providing fluid communication between the spray manifold and the fluid circulation assembly when the rack is in the first position.

2. The dishwasher appliance of claim 1, wherein the manifold cap is welded onto the rack to form the spray manifold.

3. The dishwasher appliance of claim 1, wherein the docking port comprises an orifice formed by a rear wall of the rack.

4. The dishwasher appliance of claim 3, wherein the fluid circulation assembly comprises a fluid supply nozzle configured for engaging the docking port when the rack is in the first position to provide the flow of wash fluid to the spray manifold.

5. The dishwasher appliance of claim 1, wherein the docking port is positioned at a bottom of the spray manifold along the vertical direction.

6. The dishwasher appliance of claim 1, wherein the manifold cap extends substantially along the transverse direction while a bottom wall of the manifold base slopes downward along the vertical direction toward a rear wall of the rack such that a lowest point of the spray manifold is positioned at the rear wall of the rack.

7. The dishwasher appliance of claim 1, wherein a bottom wall of the manifold base slopes downward toward the docking port along the lateral direction.

8. The dishwasher appliance of claim 1, wherein the spray manifold defines a primary spray region at a center of the rack along the lateral direction, the primary spray region extending along the transverse direction for receipt of cooking utensils, wherein the plurality of discharge ports are angled toward the primary spray region.

9. The dishwasher appliance of claim 1, wherein the plurality of channels comprise a left channel, a middle channel, and a right channel, each of the left channel, the middle channel, and the right channel extending along the transverse direction from a front wall to a rear wall of the rack and being in direct fluid communication with each other.

10. The dishwasher appliance of claim 9, wherein a plurality of discharge ports is in fluid communication with each of the left channel, the middle channel, and the right channel.

11. The dishwasher appliance of claim 1, wherein the rack extends along substantially an entire width of the wash chamber along lateral direction and substantially an entire depth of the wash chamber along the transverse direction.

12. The dishwasher appliance of claim 1, wherein the vertical support structure is a lattice structure and includes a plurality of tines extending along the vertical direction for holding articles for washing.

13. The dishwasher appliance of claim 1, wherein the plurality of distinct channels are fluidly coupled to each other at both a front of the spray manifold and a rear of the spray manifold.

14. An upper rack assembly for a dishwasher appliance, the dishwasher appliance defining a vertical, a lateral, and a transverse direction and comprising a wash tub defining a wash chamber and a fluid circulation assembly for providing a flow of wash fluid to the wash chamber, the upper rack assembly comprising:

a rack slidably positioned within the wash chamber and configured for movement along the transverse direction between a first position where the rack is positioned within the wash chamber and a second position where the rack is positioned outside the wash chamber, the rack defining a vertical support structure;

a manifold base integrally formed with the rack and forming a bottom wall of a spray manifold, the bottom wall comprising a plurality of distinct channels;

a manifold cap attached to the rack over the manifold base to form an upper wall of the spray manifold, the manifold cap defining a plurality of discharge ports positioned below a top of the manifold cap along the vertical direction; and a docking port providing fluid communication between the spray manifold and the fluid circulation assembly when the rack is in the first position.

15. The upper rack assembly of claim 14, wherein the docking port is defined by a rear wall of the rack, and wherein the fluid circulation assembly comprises a fluid supply nozzle configured for engaging the docking port when the rack is in the first position to provide the flow of wash fluid to the spray manifold.

16. The upper rack assembly of claim 14, wherein the docking port is positioned at a bottom of the spray manifold along the vertical direction.

17. The upper rack assembly of claim 14, wherein the manifold cap extends substantially along the transverse direction while a bottom wall of the manifold base slopes downward along the vertical direction toward a rear wall of the rack and downward toward the docking port along the lateral direction such that a lowest point of the spray manifold is positioned at the rear wall of the rack.

18. The upper rack assembly of claim 14, wherein the spray manifold defines a primary spray region at a center of the rack along the lateral direction, the primary spray region extending along the transverse direction for receipt of cooking utensils, wherein the plurality of discharge ports are angled toward the primary spray region.

19. The upper rack assembly of claim 14, wherein the plurality of channels comprise a left channel, a middle channel, and a right channel, each of the left channel, the middle channel, and the right channel extending along the transverse direction from a front wall to a rear wall of the rack and being in direct fluid communication with each other, and wherein a plurality of discharge ports is in fluid communication with each of the left channel, the middle channel, and the right channel.

20. The upper rack assembly of claim 14, wherein the plurality of distinct channels are fluidly coupled to each other at both a front of the spray manifold and a rear of the spray manifold.

* * * * *